United States Patent [19]

Clark

[11] 4,332,430

[45] Jun. 1, 1982

[54] PRINTED CIRCUIT BOARD CONNECTOR

[75] Inventor: Paul R. Clark, Cedar Rapids, Iowa

[73] Assignee: Rockwell International Corporation, El Segundo, Calif.

[21] Appl. No.: 225,080

[22] Filed: Jan. 14, 1981

Related U.S. Application Data

[63] Continuation of Ser. No. 88,739, Oct. 26, 1979, abandoned.

[51] Int. Cl.[3] ..... H01R 13/04

[52] U.S. Cl. ..... 339/17 C; 339/256 SP; 339/17 LC

[58] Field of Search ..... 339/17 C, 256 SP, 17 LC, 339/275 T; 179/68.5

[56] References Cited

U.S. PATENT DOCUMENTS

| | | | |
|---|---|---|---|
| 3,179,912 | 4/1965 | Huber et al. | 339/17 C X |
| 3,215,975 | 11/1965 | Kinkaid | 339/256 SP |
| 3,910,665 | 10/1975 | Stull | 339/17 C |
| 4,037,898 | 7/1977 | Guyette | 339/17 C |

FOREIGN PATENT DOCUMENTS

| | | | |
|---|---|---|---|
| 2301611 | 7/1974 | Fed. Rep. of Germany | 339/17 C |
| 2700232 | 7/1978 | Fed. Rep. of Germany | 339/17 C |

*Primary Examiner*—Eugene F. Desmond
*Attorney, Agent, or Firm*—Richard K. Robinson; Howard R. Greenberg; H. Fredrick Hamann

[57] ABSTRACT

Stability of connectors on printed circuit boards is achieved by using connectors having three legs for mounting the connector to the printed circuit board. Each leg has a shoulder stop that provides spacing above the circuit board.

2 Claims, 7 Drawing Figures

PRINTED CIRCUIT BOARD CONNECTOR

This is a continuation of application Ser. No. 88,739, filed 10/26/79, now abandoned.

BACKGROUND OF THE INVENTION

This invention relates to circuit board electrical connectors.

With the advent of modern printed circuit board technology, the miniaturization of complex circuits and the drastic reduction of the manufacturing costs of the components on printed circuit boards, there is a need to have a reliable means of connecting interconnecting cables and wires to the printed circuit board.

In the case where the signals are of relatively low power, connection to circuit boards is easily facilitated by soldering wires directly to the printed circuit boards or connecting them to spade type terminals. However, this creates problems if the printed circuit board is subject to movements in that the soldered wire is brittle and will break with very little force. In the case where the signals being conducted to the printed circuit boards have a power rating on the order of 1 watt or greater, the prior art provided for the mounting of terminal blocks to the printed circuit cards and connected the wires to these large, molded terminal blocks. The mounting of the terminal blocks to the printed circuit board is labor intensive and, as such, reduces the savings incurred by using printed circuit board technology. The prior art spade type terminals were unstable.

SUMMARY OF THE INVENTION

Stability of connectors on printed circuit boards is achieved by using connectors having three legs for mounting the connector to the printed circuit board. Each leg has a shoulder stop that provides spacing above the circuit board.

The disclosed terminal has the advantage of being mounted on the board with the other electrical components and then being secured to the printed circuit board by fow soldering or other techniques known in the art. Different embodiments of the terminals are shown, which illustrate connections of the standard industrial type spade terminals, wire wrapping connections, solder connections or compression with lugs or screw connections.

DETAILED DESCRIPTION OF THE PREFERRED EMBODIMENT

Figure 1:
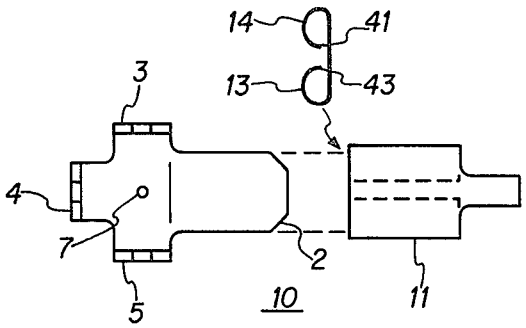
FIG. 1 is a diagram of an industrial spade type terminal connection according to the invention.

Referring to FIG. 1, there is shown a printed circuit board connector 10 that has three legs, 3, 4 and 5, and a connector 2 which in the embodiment of FIG. 1 is a male industrial spade type connector. The connector 2 is designed to receive a female type connector 11 which slides onto the male spade connector 2 and good contact is ensured by the side springs 13 and 14. The connector 10 is manufactured by stamping the connector out of a material such as brass or phosphorus bronze, and then plating with a silver lead compound. The hole in the center of the connector 7 of FIG. 1 is used in the plating process of the connector. The female spade connector is manufactured by rolling the edges to form two springs 13 and 14, whose ends 41 and 43 will press against the connector 2 to ensure good electrical contact.

Figure 2:
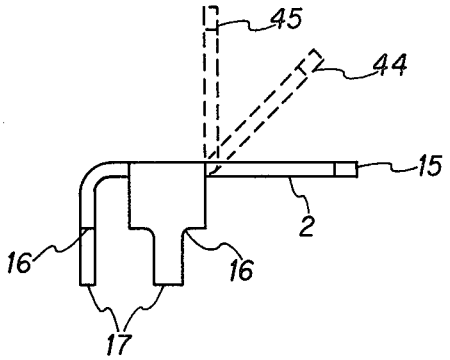
FIG. 2 is a side view of the connector according to the invention.

In FIG. 2, which is a side view of the connector, each leg has an extension 17 which extends from a mounting shoulder 16. These extensions pass through holes which are drilled in the printed circuit board and provide proper clearance for the extension 17 and the shoulders 16 which will rest on the surface of the printed circuit board. This ensures proper spacing and provides for a uniform appearance of the mounted connector on the printed circuit board. Also shown in FIG. 2, are the positions that the connector 2 may be mounted in. At 15, the connector is parallel with the mounting surface and at 44, it is at an acute angle. At 45, the connector is at a perpendicular angle.

Figure 3:
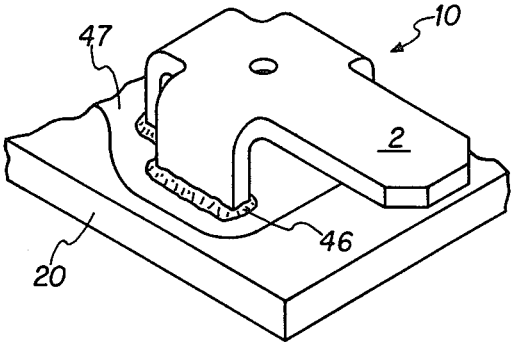
FIG. 3 is a drawing showing the connector mounted on a printed circuit board.

In FIG. 3, there is shown a printed circuit board 20 which has the connector 10 mounted thereon. After the connector is placed on the board, it is then soldered to the printed circuit board as shown at 46, and the printed conductor to which the connector is joined to extends out at 47.

Figure 4:
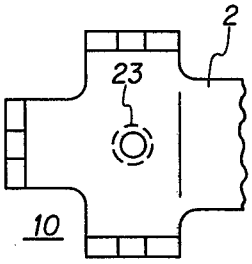
FIG. 4 is an embodiment of the invention that provides for lug type connection.
Figure 5:
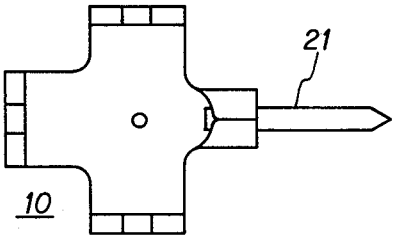
FIG. 5 is another embodiment of the invention that provides for a wire wrapped connection.
Figure 6:
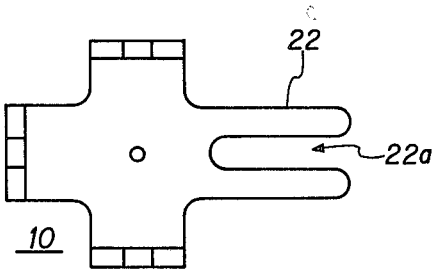
FIG. 6 is still another embodiment of the invention that provides for a solder connection.
Figure 7:
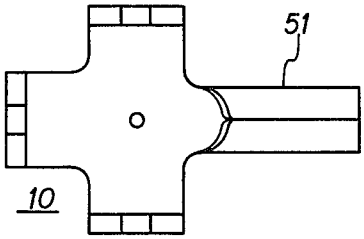
FIG. 7 is yet another embodiment of the invention that will accept a roll pin connector.

There are many types of electrical connections which can be made to the basic three leg connectors. Among these is the wire wrap type terminal 21 as shown in FIG. 5 wherein a stripped wire (not shown) is wrapped for two turns around the terminal 21 with enough torque to ensure good electrical contact with the obelisk shape that comprises the terminal 21. The basic solder terminal 22 is shown in FIG. 6 where at least one wire (not shown) is inserted into the slot 22*a* and soldered thereto. In the cases where there is a need for a screw type connection, FIG. 4 has a tapped hole 23 located within the center of the connector and wires are secured to the connector by the compression of the wire to the connector by a screw (not shown) that is tightened into the threaded hole. The spade 2 can be removed or used for an additional connection. In FIG. 7, a roll type connector 51 is provided for.

Although the invention has been described and illustrated with a certain degree of particularity, it is understood that numerous changes in the arrangement and combination of parts may be resorted to without departing from the spirit ad scope of the invention as herein described.

I claim:

1. A circuit board connector for mounting on a printed circuit board comprising:

a terminal means having a flat surface for mounting on a printed circuit board;

first and second mounting legs bent perpendicular to the flat surface and positioned in parallel alignment with each other;

an extension for receipt at a female spade terminal, the extension being positioned at right angles to the first and second mounting legs extending outward from the flat surface and, when mounted, positionable in parallel alignment with the printed circuit board, at an acute angle with the circuit board, or perpendicular with the printed circuit board;

stabilizing mounting leg means having the same shape as the first and second mounting legs for stabilizing the circuit board connector, and positioned on the opposite side of the terminal means from the extension; and mounting means for mounting the terminal means directly above the printed circuit board and spaced sufficiently from the printed circuit board for the extension (when positioned in parallel alignment with the printed circuit board) to receive the female spade terminal; the mounting means includes on each of the first and second mounting legs and the stabilizing mounting leg means a mounting shoulder and a feed-through extension extending outward from the mounting shoulder, whereby, when the circuit board connector is mounted on the circuit board, the mounting shoulder will support the terminal means in parallel alignment with the circuit board, and separate it therefrom by a distance established by the mounting shoulders.

2. The circuit board connector according to claim 1 wherein the terminal means further comprises:

a threaded hole for receipt of a screw whereby a wire may be compressed between the surface of the connector and the head of the screw.

* * * * *

UNITED STATES PATENT AND TRADEMARK OFFICE

CERTIFICATE OF CORRECTION

PATENT NO. : 4,332,430

DATED : June 1, 1982

INVENTOR(S) : Paul R. Clark

It is certified that error appears in the above-identified patent and that said Letters Patent are hereby corrected as shown below:

Column 1, line 12, delete "costs" and substitute therefor --cost--;

line 42, delete "fow" and substitute therefor --flow--.

Signed and Sealed this

*Tenth* Day of *August 1982*

[SEAL]

*Attest:*

GERALD J. MOSSINGHOFF

*Attesting Officer*

*Commissioner of Patents and Trademarks*